US005481353A

United States Patent [19]

Hicks et al.

[11] Patent Number: 5,481,353

[45] Date of Patent: Jan. 2, 1996

[54] APPARATUS FOR PRODUCING VARIABLE FEATURE PRESENTATION SETS

[75] Inventors: Derrek C. Hicks, West Henrietta; Keith G. Bunker, Hilton; Riley L. Warddrip, Pittsford, all of N.Y.

[73] Assignee: Xerox Corporation, Stamford, Conn.

[21] Appl. No.: 332,314

[22] Filed: Oct. 31, 1994

[51] Int. Cl.[6] ..... G03G 21/00

[52] U.S. Cl. ..... 355/311; 355/325; 355/326 R; 358/451; 358/452

[58] Field of Search ..... 355/200, 202, 355/209, 323, 308, 309, 311, 321, 325, 326 R, 327; 358/450, 451, 452, 453; 346/153.1, 160

[56] References Cited

U.S. PATENT DOCUMENTS

| | | | |
|---|---|---|---|
| 4,681,428 | 7/1987 | Devoy . | |
| 4,681,428 | 7/1987 | Devoy | 355/14 |
| 4,887,129 | 12/1989 | Shenoy et al. | 355/202 X |
| 4,925,171 | 5/1990 | Kramer et al. | 270/53 |
| 4,932,644 | 6/1990 | Nzei | 270/52 |
| 4,949,128 | 8/1990 | Parsons | 355/271 |
| 4,989,042 | 1/1991 | Muramatsu | 355/202 X |
| 5,036,361 | 7/1991 | Filion et al. | 355/209 |
| 5,049,929 | 9/1991 | Anderson et al. | 355/204 |
| 5,098,074 | 3/1992 | Mandel et al. | 270/53 |
| 5,109,252 | 4/1992 | Schott | 355/209 X |
| 5,177,543 | 1/1993 | Rodenberg | 355/271 |
| 5,208,902 | 5/1993 | Kumon | 355/311 X |
| 5,257,074 | 10/1993 | Kamei | 355/202 X |
| 5,337,161 | 8/1994 | Hube | 358/448 |
| 5,338,1017 | 8/1994 | Stemmle | 270/53 |
| 5,343,275 | 8/1994 | Sulenski | 355/202 |
| 5,361,134 | 11/1994 | Hu et al. | 355/202 X |
| 5,371,574 | 12/1994 | Ohmura et al. | 355/202 X |
| 5,383,027 | 1/1995 | Harvey et al. | 358/452 X |
| 5,387,986 | 2/1995 | Gerhart | 358/452 |
| 5,405,723 | 4/1995 | Rhodes et al. | 355/327 X |

OTHER PUBLICATIONS

Xerox 5760/5765 Digital Color Copier Operator Manual; Majestik Color Series, Sep. 1993 by Xerox Corporation, pp. 6–6, 6–7; pp. 8–11 to 8–13.

Xerox 5670/5765 Digital Color Copier Operator Manual, Majestik Color Series, Sep. 1993 by Xerox Corporation, pp. 10–1 to 10–31; pp. 14–1 to 14–7.

Xerox 5100 Copier Duplicator; Operator Manual Sep. 1991; pp. 5–27.

*Primary Examiner*—R. L. Moses

[57] ABSTRACT

An apparatus for producing variably compiled presentation and supporting page sets, which may include multimedia, transparency, divider, master set and/or handout output sets created, modified, viewed and/or printed according to an array of color, editing and image modification features. Dividers may be automatically produced and interleaved between transparencies, so as to include modified images, additional information or other material not found on the set of transparencies. A master set and/or handout sets may also be produced and variably complied and sorted, and may include modified images, additional information or sheets or other material not found on the set of transparencies or the set of dividers.

15 Claims, 7 Drawing Sheets

APPARATUS FOR PRODUCING VARIABLE FEATURE PRESENTATION SETS

The present invention relates to an apparatus for producing variable feature presentation sets, and more particularly to a copier or printer capable of producing variably compiled multimedia, transparency, divider, master set and/or handout output sets according to an array of color, editing and image modification features.

In electrophotographic applications such as xerography, a charge retentive photoreceptor belt or drum is electrostatically charged according to the image to be produced. In a digital printer, an input device such as a raster output scanner controlled by an electronic subsystem can be adapted to receive signals from a computer and to transpose these signals into suitable signals so as to record an electrostatic latent image corresponding to the document to be reproduced on the photoreceptor. In a digital copier, an input devices such raster input scanner, user interfaces, touch input display screens and many other devices controlled by electronic subsystems can be adapted to input and modify an electrostatic latent images to be transferred to sheets from a photoreceptor. In a light lens copier, the photoreceptor may be exposed to a pattern of light or obtained from the original image to be reproduced. In each case, the resulting pattern of charged and discharged areas on photoreceptor form an electrostatic charge pattern (an electrostatic latent image) conforming to the original image. In single or multicolor copiers and printers, the image may be fixed to plain paper, transparencies, cover or tab stock as well as other sheet types, and thereafter sorted and finished by a wide variety of systems.

Various approaches have been employed to produce and sort sheets in copying or printing machines, including the following disclosures that may be relevant:

U.S. Pat. No. 5,337,161 Patentee: Hube Issued: Aug. 9, 1994

U.S. Pat. No. 5,177,543 Patentee: Rodenberg et al Issued: Jan. 5, 1993

U.S. Pat. No. 5,049,929 Patentee: Anderson et al Issued Sep. 17, 1991

U.S. Pat. No. 5,036,361 Patentee: Filion et al Issued: Jul. 30, 1991

U.S. Pat. No. 4,949,128 Patentee: Parsons Issued Aug. 14, 1990

U.S. Pat. No. 4,932,644 Patentee: Nzei Issued: Jun. 12, 1990

U.S. Pat. No. 4,681,428 Patentee: Devoy Issued: Jul. 21, 1987

Xerox 5760/5765 Digital Color Copier

Operator Manual, pp. 6—6 to 6–7; 8–12 to 8–13 Copyright September 1993

Xerox 5775 Digital Color Copier Operator Manual, pp. 10–1 to 10–31; 14–1 to 14–7 Copyright September 1992

Xerox 5100 Copier/Duplicator Operator Manual, p. 5–27 Copyright September 1991

U.S. Pat. No. 5,337,161 discloses a feature for automatically shifting a image for placement on a sheet having tabs. The image portions may be selected such that a heading will be retained in memory for later printing on tab stock. Tab headings may be rotated and scaled for placement on a tab of a sheet, headings may be a stored sequentially and edited.

U.S. Pat. No. 5,177,543 discloses blank sheets being transported through the normal printing paper path, even no image is not written on the sheet. Such sheets may be used as spacer sheets to be inserted between transparencies, cover sheets for reports, separator sheets between chapters, etc. Machine logic and software normally does not activate the development station for blank sheets. Interleaving plain paper separator sheets between adjacent transparencies is used to solve the problem of transparencies sticking together. The separator sheets may be blank or may contain the same information as the adjacent transparency.

U.S. Pat. No. 5,049,929 discloses a "Tabs" feature for automatically shifting a copied image as placed on the copy sheet to accommodate tabs. The Tabs feature may be selected such that a message suggesting production of a single sample or "proof" copy set will be generated and displayed on a CRT display. Other features include Duplex To Simplex, Transparency Dividers, Auto Paper Select and other features.

U.S. Pat. No. 5,036,361 discloses a display for three trays containing paper stock or copy sheets. Trays contemplated include those for paper stock, cover sheets and various inserts such as tabs and dividers, including such things as transparencies.

U.S. Pat. No. 4,949,128 discloses an apparatus and method for increasing the throughput speed in copiers and printers which produce color transparency output sheets separated by special or slip sheets. A frame transfer sequence is used wherein separate component color images for different output sheets are intermixed on different areas of the transfer member at the same time. After one area contains all of the component images, the composite image is removed and the corresponding frame is skipped while the interleaving sheet is fed through the transfer station of the apparatus. The sequence is repeated until the desired number of output copies are obtained.

U.S. Pat. No. 4,932,644 discloses a process for feeding transparency sheets having a soft coating thereon from a tray of such sheets. The transparency sheets are interleaved with plain paper separator sheets in a tray so that at the front end of the tray, the ends of the plain paper separator sheets extend beyond the ends of the transparency sheets. A sheet feed means positioned adjacent the front end of the tray engages the extended end of the first of the plain paper separator sheets in the tray. At start up, the sheet feed means does not engage the transparency sheets. The sheet feed means moves the engaged plain paper separator sheet from the tray wherein the movement of the engaged plain paper separator sheet moves the adjacent transparency sheet from the tray.

U.S. Pat. No. 4,681,428 discloses means for alternately presenting copy sheets of either a first characteristic or a second characteristic to an image receiving position from respective first and second copy sheet supplies. A set of document originals are sequentially copied onto copy sheets (such as transparencies) presented at the image receiving position, with copies of successive document originals of the set being copied onto successive copy sheets from the first supply. Copy sheets from the second supply may be left blank or may receive images of successive document originals of the set such that each original is copied multiple times, at least once onto a copy sheet of the first characteristic and at least once onto a copy sheet of the second characteristic.

The Xerox 5760/5765 and 5775 Digital Color Copier Operator Manuals disclose edit pads and touch input/display screens, which may be used to edit scanned images, output multi-sheet enlarged copies according to a "poster" function and otherwise perform a variety of creative editing functions. The 5760/5765 further discloses an interleaving paper feature to place blank paper sheets between adjacent transparencies.

The Xerox 5100 Copier/Duplicator Operator Manual discloses interleaving paper separator sheets between adjacent transparencies. The separator sheets may be blank or may contain the same information as the adjacent transparency.

In accordance with one aspect of the present invention, there is provided an apparatus for producing sorted document sets, including a generating means for producing a set of presentation documents including a primary image area thereon, an input means for producing a set of supporting documents including an edited image area thereon and an output means for sorting and displaying the set of presentation documents from the generating means and the set of supporting documents from the input means.

The invention will be described in detail with reference to the following drawings, in which like reference numerals are used to refer to like elements. The various aspects of the present invention will become apparent as the following description proceeds and upon reference to the drawings, in which.

Figure 1:
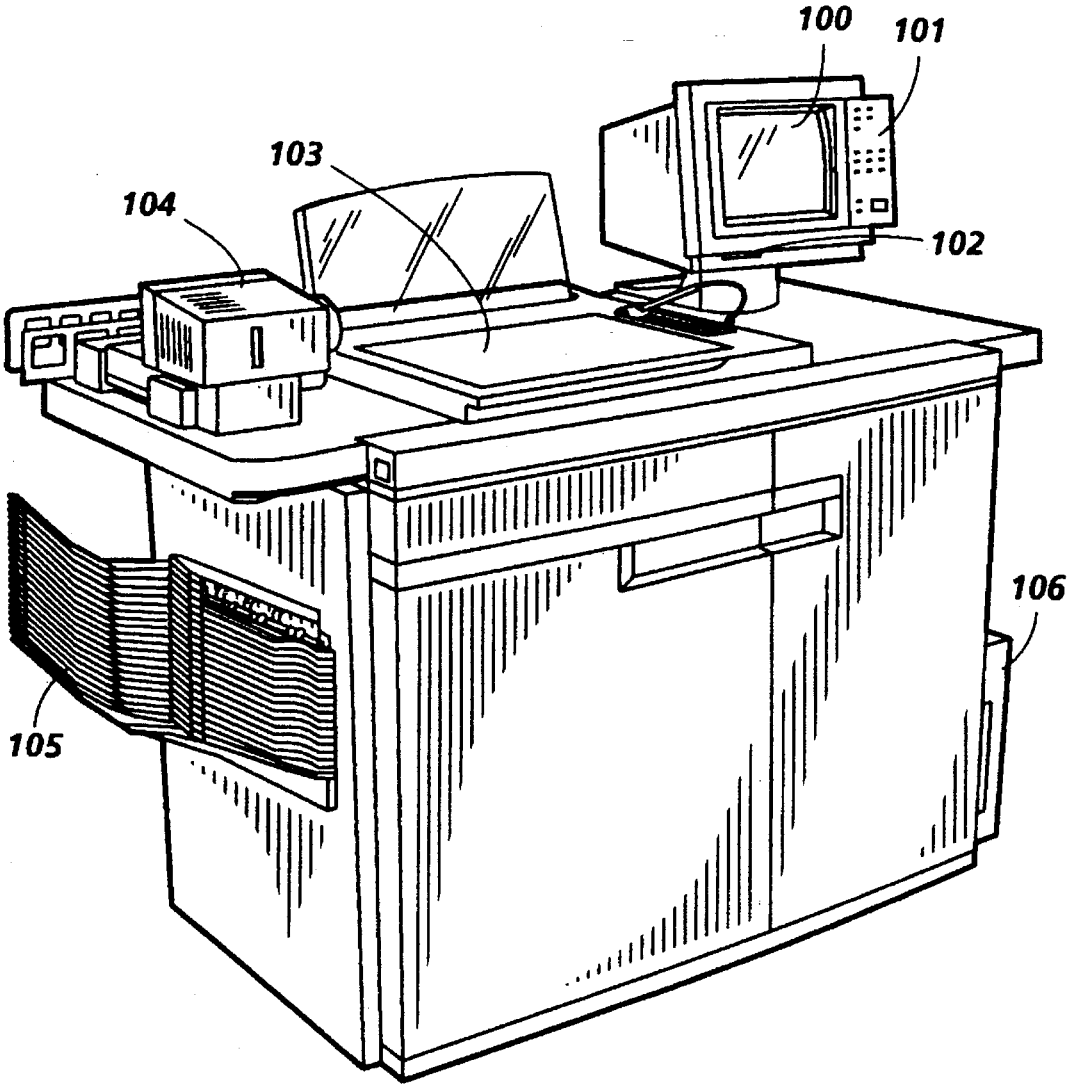
FIG. 1 is an perspective view of a printing system which may incorporate the features of the present invention therein.

While the present invention will hereinafter be described in connection with preferred embodiments, it will be understood that it is not intended to limit the invention to a particular embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate like elements. It will become evident from the following discussion that the present invention and the various embodiments set forth herein are suited for use in a wide variety of printing and copying systems, and are not necessarily limited in its application to the particular systems shown herein.

Figure 7:
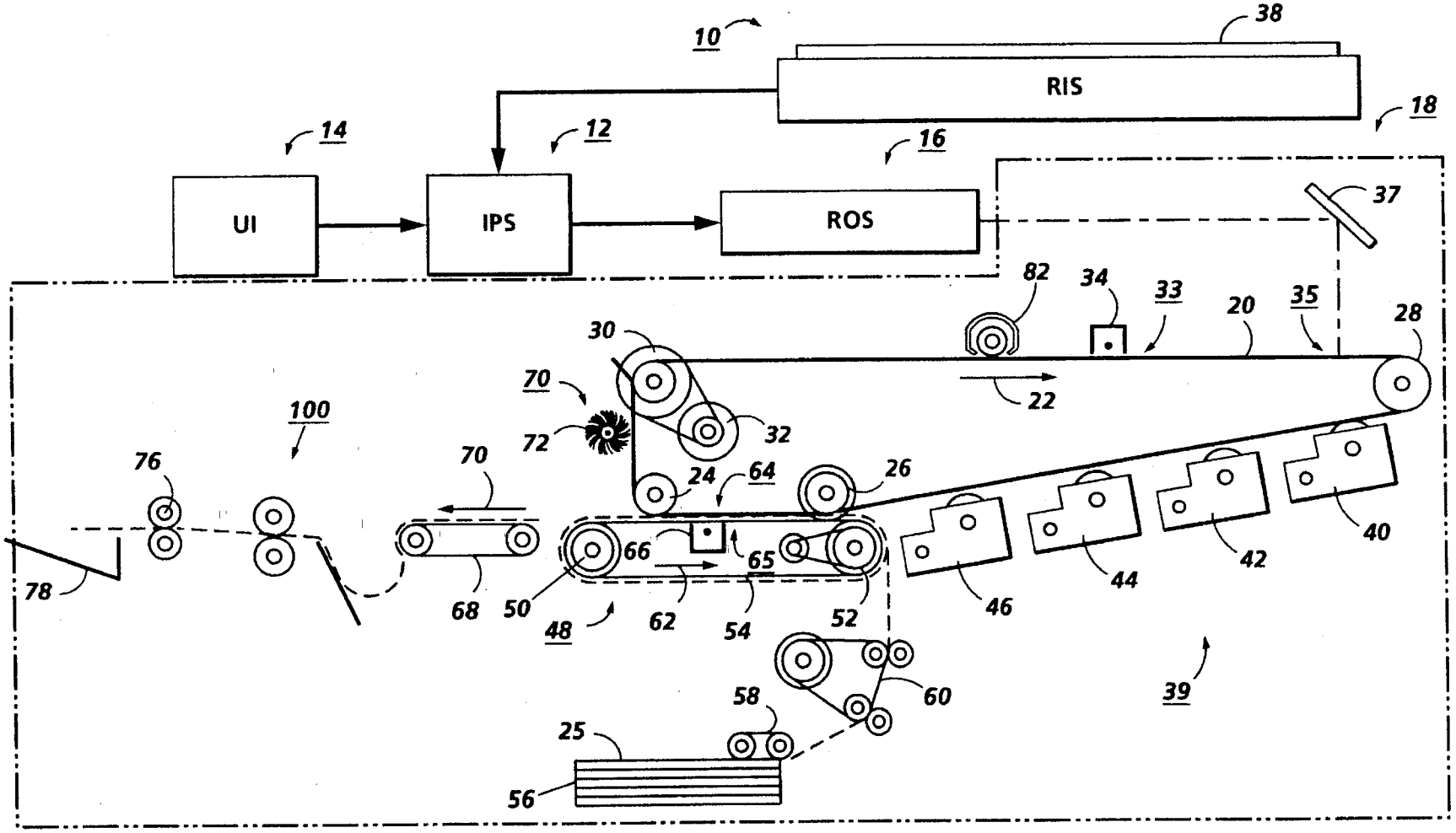
FIG. 7 is a schematic, elevational view showing an exemplary color electrophotographic printing machine which may incorporate the features of the present invention therein.

To begin by way of general explanation, as shown in FIG. 7, during operation of the printing system, a multiple color original document 38 is positioned on a raster input scanner (RIS), indicated generally by the reference numeral 10. The RIS contains document illumination lamps, optics, a mechanical scanning drive, and a charge coupled device (CCD array). The RIS captures the entire image from original document 38 and converts it to a series of raster scan lines and moreover measures a set of primary color densities, i.e. red, green and blue densities, at each point of the original document. This information is transmitted as electrical signals to an image processing system (IPS), indicated generally by the reference numeral 12. IPS 12 converts the set of red, green and blue density signals to a set of colorimetric coordinates. An automatic document feeder (not shown) may be used to sequentially supply sheets for input scanning by RIS 10.

The IPS contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The operator actuates the appropriate keys of UI 14 to adjust the parameters of the copy. UI 14 may be a touch screen, or any other suitable control panel, providing an operator interface with the system; one embodiment of UI 14 is described in greater detail in association with FIG. 2. The output signal from UI 14 is transmitted to IPS 12. The IPS then transmits signals corresponding to the desired image to ROS 16, which creates the output copy image. ROS 16 includes a laser with rotating polygon mirror blocks. Preferably, a nine facet polygon is used. The ROS illuminates, via mirror 37, the charged portion of a photoconductive belt 20 of a printer or marking engine, indicated generally by the reference numeral 18, at a rate of about 400 pixels per inch, to achieve a set of subtractive primary latent images. The ROS will expose the photoconductive belt to record three or four latent images which correspond to the signals transmitted from IPS 12. One latent image is developed with cyan developer material. Another latent image is developed with magenta developer material and the third latent image is developed with yellow developer material. A black latent image may be developed in lieu of or in addition to other (colored) latent images. These developed images are transferred to a copy sheet in superimposed registration with one another to form a multicolored image on the copy sheet. This multicolored image is then fused to the copy sheet forming a color copy.

With continued reference to FIG. 7, printer or marking engine 18 is an electrophotographic printing machine. Photoconductive belt 20 of marking engine 18 is preferably made from a photoconductive material. The photoconductive belt moves in the direction of arrow 22 to advance successive portions of the photoconductive surface sequentially through the various processing stations disposed about the path of movement thereof. Photoconductive belt 20 is entrained about rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform potential.

Next, the charged photoconductive surface is rotated to an exposure station, indicated generally by the reference numeral 35. Exposure station 35 receives a modulated light beam corresponding to information derived by RIS 10 having multicolored original document 38 positioned thereat. The modulated light beam impinges on the surface of photoconductive belt 20. The beam illuminates the charged portion of the photoconductive belt to form an electrostatic latent image. The photoconductive belt is exposed three or four times to record three or four latent images thereon.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the complement of the specific color separated electrostatic latent image recorded on the photoconductive surface.

The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is substantially adjacent the photoconductive belt, while in the nonoperative position, the magnetic brush is spaced therefrom. During development of each electrostatic latent image, only one developer unit is in the operative position, the remaining developer units are in the nonoperative position. This insures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper (not shown in FIG. 7) extends between belts 54 and moves in unison therewith. A sheet 25 is advanced from a stack of sheets 56 disposed on a tray. A friction retard feeder 58 advances the uppermost sheet from stack 56 onto a pre-transfer transport 60. Transport 60 advances sheet 25 to sheet transport 48. Sheet 25 is advanced by transport 60 in synchronism with the movement of the sheet gripper. In this way, the leading edge of sheet 25 arrives at a preselected position, i.e., a loading zone, to be received by the open sheet gripper. The sheet gripper then closes securing sheet 25 thereto for movement therewith in a recirculating path. The leading edge of sheet 25 is secured releasably by the sheet gripper. As belts 54 move in the direction of arrow 62, the sheet moves into contact with the photoconductive belt, in synchronism with the toner image developed thereon. In transfer zone 64, a gas directing mechanism (not shown) directs a flow of gas onto sheet 25 to urge the sheet toward the developed toner image on photoconductive member 20 so as to enhance contact between the sheet and the developed toner image in the transfer zone. Further, in transfer zone 64, a corona generating device 66 sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this way, three or four different color toner images are transferred to the sheet in superimposed registration with one another.

One skilled in the art will appreciate that the sheet may move in a recirculating path for four cycles when under color black removal is used. Each of the electrostatic latent images recorded on the photoconductive surface is developed with the appropriately colored toner and transferred, in superimposed registration with one another, to the sheet to form the multicolored copy of the colored original document.

After the last transfer operation, the sheet transport system directs the sheet to a vacuum conveyor 68. Vacuum conveyor 68 transports the sheet, in the direction of arrow 70, to a fusing station, indicated generally by the reference numeral 100, where the transferred toner image is permanently fused to the sheet. The toner image is contacted by one or more sets of fuser rolls so as to be affixed to the sheet. Thereafter, the sheet is advanced by a pair of rolls 76 to a catch tray 78 or a sorter as further described in association with FIG. 1 for sorting and eventual removal therefrom by the machine operator.

The final processing station in the direction of movement of belt 20, as indicated by arrow 22, is a photoreceptor cleaning apparatus, indicated generally by the reference numeral 70. A rotatably mounted fibrous brush 72 may be positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

FIG. 1 shows a perspective view of an exemplary color electrophotographic printing/copying machine such as shown in FIG. 7. The color electrophotographic printing machine of FIG. 1 further includes a touch screen/display 100, a control panel 101, a memory card slot 102 and an edit pad 103, each of which may be incorporated into UI 14 as shown in FIG. 7. Edit pad 103 and/or touch screen/display 100 may be used as means for inputting information or otherwise modifying or creating images, such images to be shown on presentation or transparency sheets, as well as on divider, master and/or handout sheets (as described more fully in conjunction with FIGS. 2–6 below). The printing machine of FIG. 1 further may also include a projector 104 for inputting projected images into the RIS. The printing machine of FIG. 1 further includes an output sheet sorter (described in greater detail below to include by incorporation by reference) generally indicated by the number 105 for variably distributing sheets to various output trays, and a additional sheet feeder and tray assembly 106 for providing transparency, plain paper and/or other sheets to the printer/copier.

Figure 2:
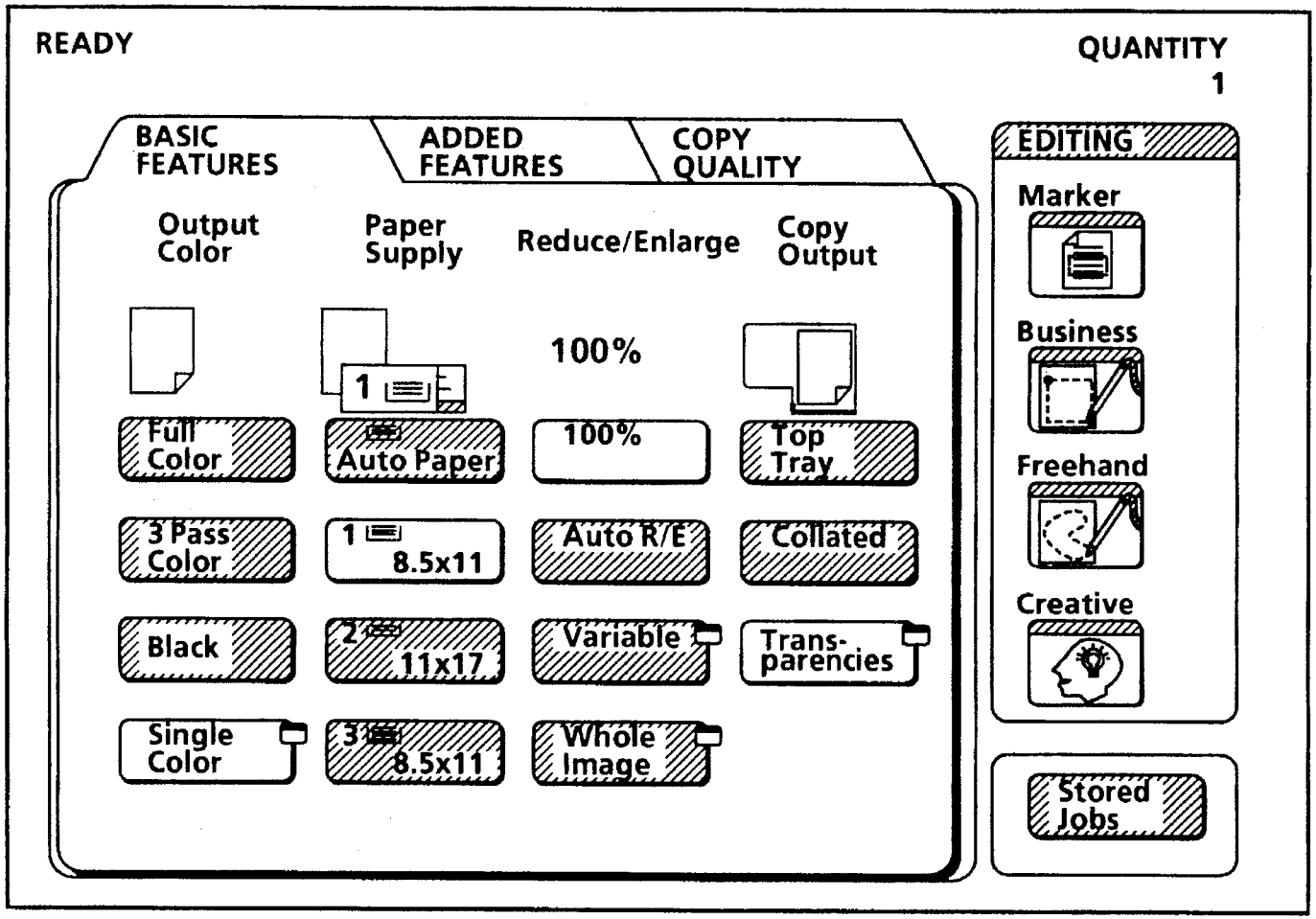
FIG. 2 is an elevation view of a touch screen and/or display which may incorporate the features of the present invention therein.

FIG. 2 shows a basic features folder in which various copier/printer functions can be accessed by depressing the appropriate location on a touch screen as shown in FIG. 2. The FIG. 2 touch screen includes the "Transparency Sets" touch screen button for initiating the transparency (or presentation) and supporting (divider, master and handout) sets system of the present invention.

Figure 3:
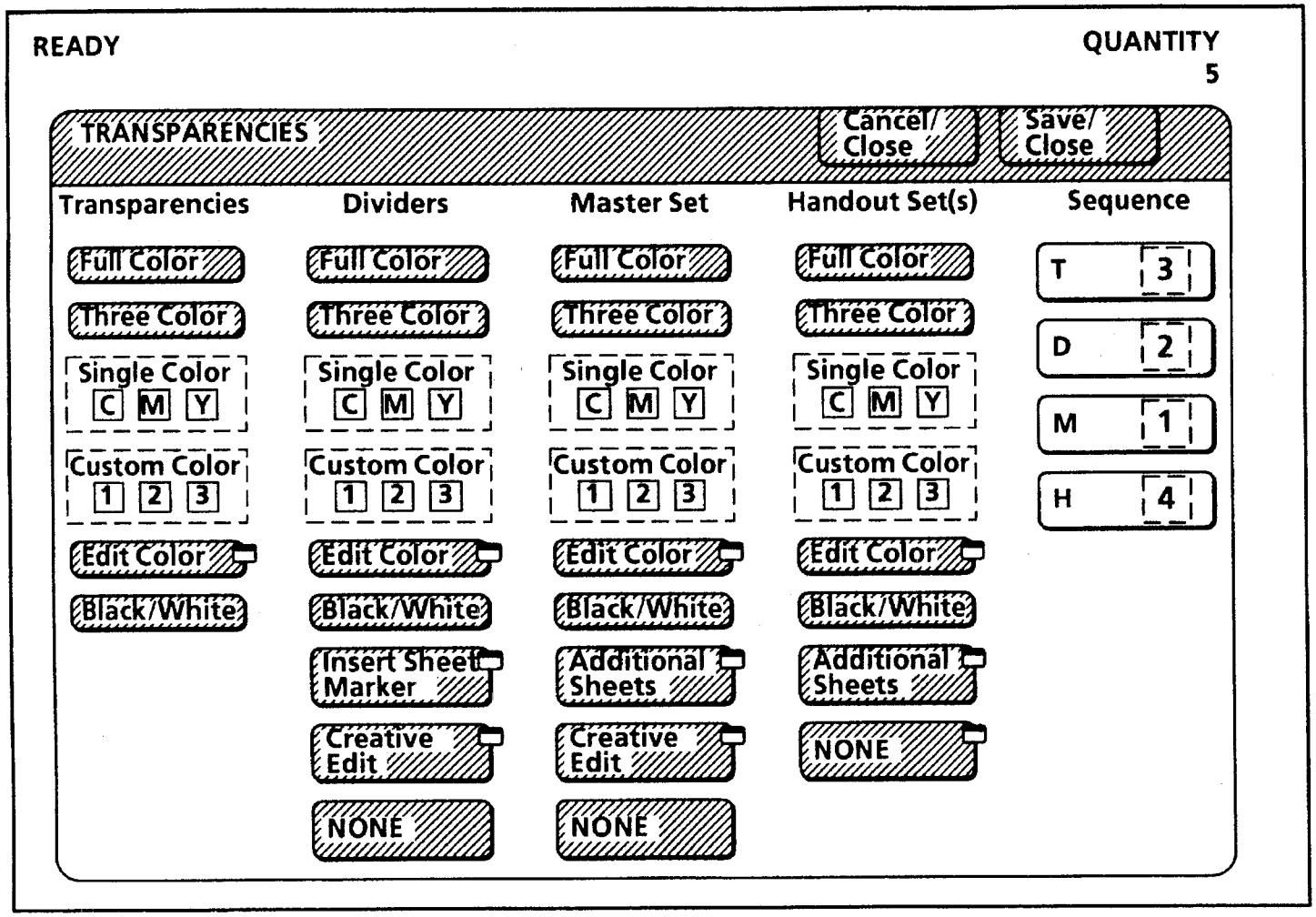
FIG. 3 is an elevation view of a touch screen and/or display of the present invention.

FIG. 3 shows one embodiment of a pop-up frame for mouse designation, a pressure or finger proximity touch screen, or other interactive display system (such as shown on touch screen 100/UI 14 of FIGS. 1 and 7. in which features can be selected by depressing or other wise selecting buttons. (Various selections possible with the "Transparency" sets button shown in FIG. 2 are shown in the associated pop-up screen and buttons of FIG. 3; in FIGS. 2 and 3, exemplary buttons that may be accompanied by a pop-up screen (the example of the present embodiment) are shown by a touch button with a reduced size pop-up screen indicating icon at the upper right corner of the touch button.) In the FIG. 3 pop-up screen embodiment, four categories of output sheets may be created by the transparency sets pop-up screen, to include "Presentation" sheet sets such as Transparencies or Opaque sets, as well as "Supporting" sheet sets such as Dividers, Master Set and Hand-out Sets. The user may elect to print all Transparencies, Dividers, Master Set and Hand-out Sets in the order shown (left to right), or may reorder the sequence of set printed or copied. In the this manner, the interleaved dividers may precede or follow the transparency sheets. Likewise, or alternatively, (as detailed below) the Master Set may be interleaved to precede or follow the transparency or presentation sheets. The Handout Sets may be sorted into a single stack to precede or follow the Transparencies, Dividers and Master Set in the stack. Many sorting options are available through default operation or pop-up screen operator election are possible; while several embodiments are described, each pop-up screen and its described/outlined functions and selections are not shown.

With continued reference to FIG. 3, in the case of each of the categories of output sets, an operator may select "Transparencies" in Full (four) Color, Three Color, Single Color (toner), Custom Color (such as by selection of predesignated custom colors 1, 2 or 3), Edit Color, Black and White or Creative Edit. In the case of the transparency "Dividers", an operator may select to print the dividers in Full Color, Three Color, Single Color, Custom Color, Edit Color, Black and White, Insert Sheet Marker (divider page markings, printed on standard or other sheets, which may include order/subject matter designations, such as A, B, C . . . ; Transparency 1 of 5; "New Projects", "Sales Goals", etc.) or Creative Edit. An operator may also elect "None" so as to include no dividers (as described above) at all. In one embodiment, if "None" is selected as the Transparency Divider option, the system defaults to interleaving the transparencies with the Master Set; if "None" is selected for both the Master Set and Transparency Divider options, the system defaults to no sheets being interleaved between transparencies. An operator may also select to print the "Master Set" in Full Color, Three Color, Single Color, Custom Color, Edit Color, Black and White, Additional Sheets (so as to include further sheets not made into transparencies). Likewise, an operator may also select to print the "Handout Set(s)" in Full Color, Three Color, Single Color, Custom Color, Edit Color, Black and White, with Additional Sheets, or not at all ("None"). When modified color outputs are selected, printing of supporting documents such as handouts can be accomplished more rapidly and cost effectively; for example, when a multi-pass (such as four color) printer is used, when three color, black and white or otherwise reduced color passes are required, faster and less expensive output sheet printing is accomplished.

Other categories and types of documents may also be used to create presentation and supporting document sets. For example, one embodiment may permit the creation of opaque sheet presentation sets in which a divider is a single standard sheet (with various modifications described in conjunction with FIGS. 3 and 4 herein), while the Presentation document is created according to a selectable "Poster" feature option (not shown in FIG. 3 or 4), in which a primary image on the presentation set is magnified to cover multiple printed output sheets, such as may be produced with a Xerox 5760 or 5765 Digital Color Copier.

A user may, according to the "Sequence" column of the Transparencies screen of FIG. 3, vary the order of output of each of the categories; for example, by pressing the sequence buttons in the order M (1), D (2), T(3) and H(4), the system will place the Master Set on the top of a set of interleaved Dividers and Transparencies (dividers first) and followed by the selected number of Handout Sets. The system may sort the sequenced outputs into a single stack (face up or face down, depending on the printer/sorter employed) or supply them in trays, such as the Master Set in the top tray, interleaved Dividers and Transparencies in the next tray, followed by Handout Sets (separated into individual trays or stacked in one tray). When individual tray sorting is used, the printing system may produce all of a particular page at the same time (see FIG. 4 and accompanying discussion below). When stack sorting is used to produce sets from hard copies, the system will be required to sort through the stack each time in order to produce the particular page required; likewise when stapled output sets are desired. (See the disclosures of U.S. Pat. No. 5,338,017 (Sorter and Finisher Apparatus), U.S. Pat. No. 5,098,074 (Finisher Apparatus) and U.S. Pat. No. 4,925,171 (Sorter/Stapler With Horizontal Bin Opening), each assigned to Xerox Corporation and incorporated herein by reference.) When an electronic document is used to produce sets, automatic electronic sorting between particular pages will be required, again depending on the output sets selected and produced.

Figure 4:
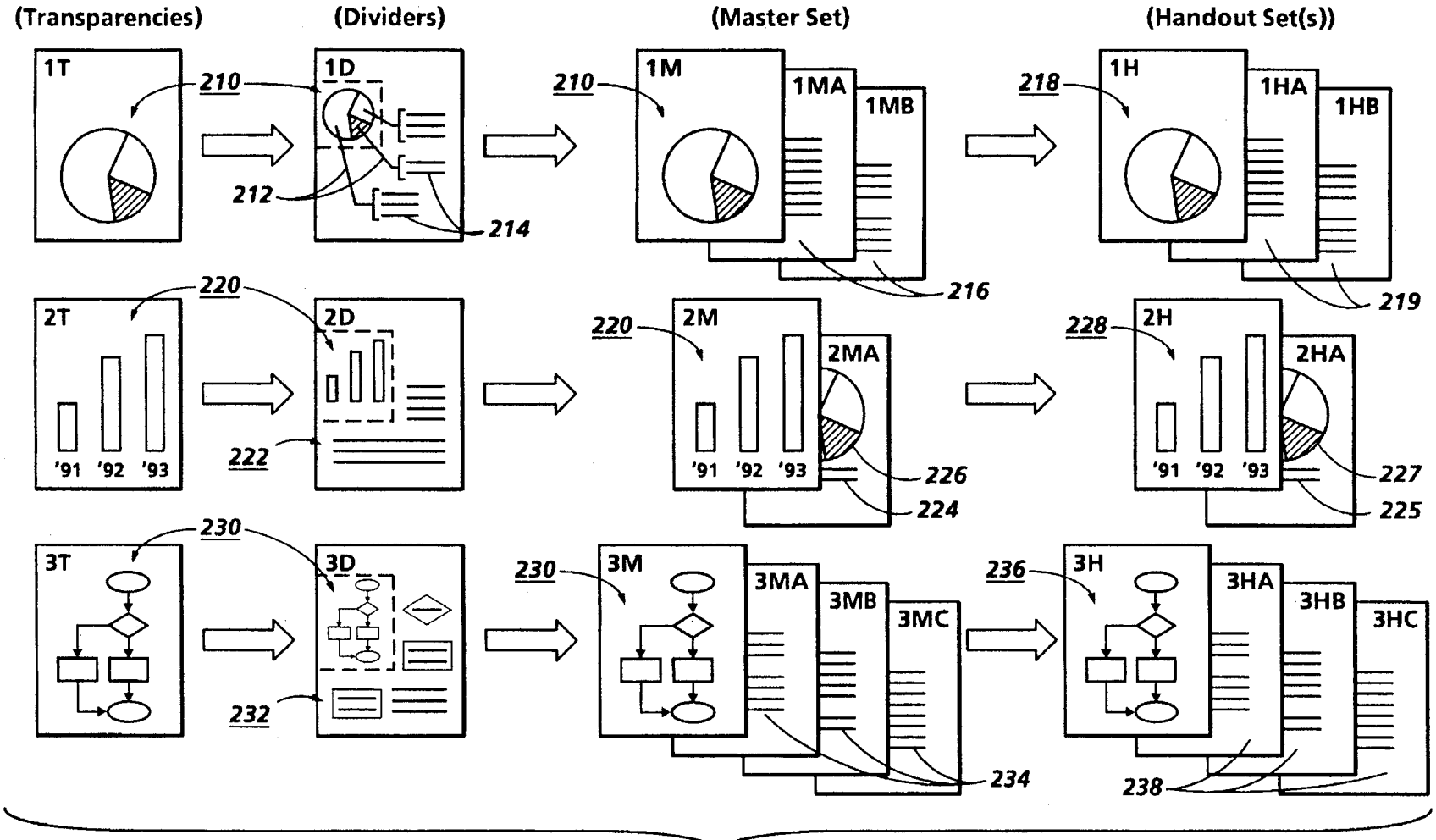
FIG. 4 is an elevation view of a output, touch screen and/or display of the present invention.

FIG. 4 shows an exemplary document display and/or printed document output as may be produced by the transparency/presentation sets system of the present invention. In the example shown, an original document (hardcopy or electronic) including three pages to be produced as transparencies is selected. In one embodiment, the primary images on the presentation documents and the edited images on the supporting documents may be printed or displayed so as to automatically include a set of sort order designations (e.g. the 1T, 3MA, etc. designations as shown on the FIG. 4 documents) so as to indicate the sort and/or set order of the documents according to the options and sequencing selected according to the FIG. 3 touch screen display. Sheet 1T includes a full color (primary) image 210. An operator has elected to select the transparency window function (described in greater detail of associating with FIG. 5) such that sheet 1D includes a reduced sized edited image 210 in one portion of the sheet. When a user selects an output in the "Divider", "Master Set" or "Handout Sets" category/column of FIG. 3 other than "None", that category of documents (such as "Divider" 1D, 2D and 3D set as shown on FIG. 4)

is automatically generated. The user has employed "Creative Edit" (FIG. 3) to add lines 212 directing a presenter to relate detailed explanation portions 214 to the appropriate portions of reduced sized image 210, on document 1D, thus assisting the presenter in delivering a presentation using transparency 1T. The dividers 1D may be interleaved in sorting or on the display, so that each "Divider" follows each associated "Transparencies" sheet, such as the order 1T, 1 D, 2T, 2D, 3T and 3D).

FIG. 4 further shows a master set including a modified (master) image 220, such as may include a modified version of the primary image 210, which may have fewer colors than the full color image 210 shown on the transparency (such as 3 pass color or black and white). When a hard copy or electronic document is used to generate transparencies, dividers, and/or handouts, the master document set may in some embodiments be used as the document upon which the other (edited) documents are based. FIG. 4 further shows accompanying sheets 1MA and 1MB providing additional background information 216 to supplement the presentation made using transparency 1T. Sheet 1H shows a further modified (handout) image 218, such as a single color or black and white image, along with sheets 1HA and 1HB including accompanying information 219.

With continued reference to FIG. 4, exemplary output sheet 2T includes a full color image 220. An operator has again elected to select the transparency window function such that sheet 2D includes a modified (reduced sized) image 220 in one portion of the sheet, with further detailed explanation portions 222 used to assist the presenter in delivering a presentation using transparency 2T. FIG. 4 further shows a master set including a master image 220, such as includes the full color image 220 shown on the transparency; the accompanying sheets 2MA provides further colorized graphics 226 and background information 224 to supplement the presentation made using transparency 2T. Sheet 2H shows a further modified primary image, single color handout image 228, along with sheets 2HA including accompanying information, in the-form black and white graphics 227 background information 225 (matching colorized graphics 226 and background information 224 found on sheet 2MA).

With continued reference to FIG. 4, exemplary output sheet 3T includes a single color flow chart 230. An operator has again elected to select the transparency window function, such that sheet 3D includes a reduced sized image 230 in one portion of the sheet; further detailed explanation portions 232 are colorized using the creative edit function, so as to match graphic portions of one color to text portions of the same color (not shown) to assist the presenter in delivering a presentation using transparency 3T. FIG. 4 also shows a master set including a modified image 230, such as includes the multicolor image 230 shown on sheet 3T; the accompanying sheets 3MA 3MB and 3MC provide further uncolorized background information 234 to supplement the presentation made using transparency 3T. Sheet 3H shows image 236, in a single color, along with sheets 3HA, 3HB, 3HC and 3HD including accompanying information in the form black and white text 238. According to the sequence and quantity selected in FIG. 3, a final stack/sheet set order of a FIG. 4 printed output would be:

Stack 1 (one serial master set): 1 M, 1MA, 1MB, 2M, 2MA, 3M, 3MA, 3MB, 3MC Stack 2 (one interleaved divider and transparency set): 1D, 1T, 2D, 2T, 3D, 3T Stack 3 (five serially handout sets, each including): 1H, 1HA, 1HB, 2H, 2HA, 3H, 3HA, 3HB, 3HC In another embodiment of the present invention, a display screen on a screen (or series of display screens for a larger job), such as display/touch screen 100, may permit the entire electronically stored/computerized presentation/supporting document set (such as as shown in FIG. 4) to be shown for viewing, editing/modification or printing. A presentation may be made by accessing the-desired electronic page(s) on the screen, printing out certain presentation or supporting pages onto paper or transparency sheets, or a combination of both. By designating any particular document icon (such as 1T to 3HC) on the screen, individual pages may be displayed, reordered, modified or printed. Input and output sheet trays are programmed so as to feed the necessary sheet for printing (transparency, plain paper, etc.). When printing is ordered, UI selects sheet order, with sheet provided on an as needed basis. With programmable trays and an output sorter automatically selectable on an as required basis, the required pattern of sheet (transparencies, paper, etc.) feeding can be automatically defined and executed. Additionally, job portions (such as handout and master sets) can be stapled together (by a stapler, not shown) to generate the desired multiple stapled job portions. unless specific modifications are desired and initiated by the operator, a user is therefor not required to manually change or reselect sheet trays to execute portions of the job; collation, interleaving, stapling and all presentation and supporting document set assembly tasks are automatically accomplished according to job parameters for each job.

In still other embodiments, a display system itself (such as touch screen 100, an enlarged version of touch screen 100 or other UI-associated display, not shown) may be used to make the presentation, in lieu of the use of transparencies. In these embodiments, for example, Master and Handout Sets may be printed out, while a screen or multimedia presentation may be made using the displayed electronic versions of the "Transparencies" and "Dividers" (such as documents 1D, 1T, 2D, 2T, 3D and 3T of FIG. 4).

Figure 5:
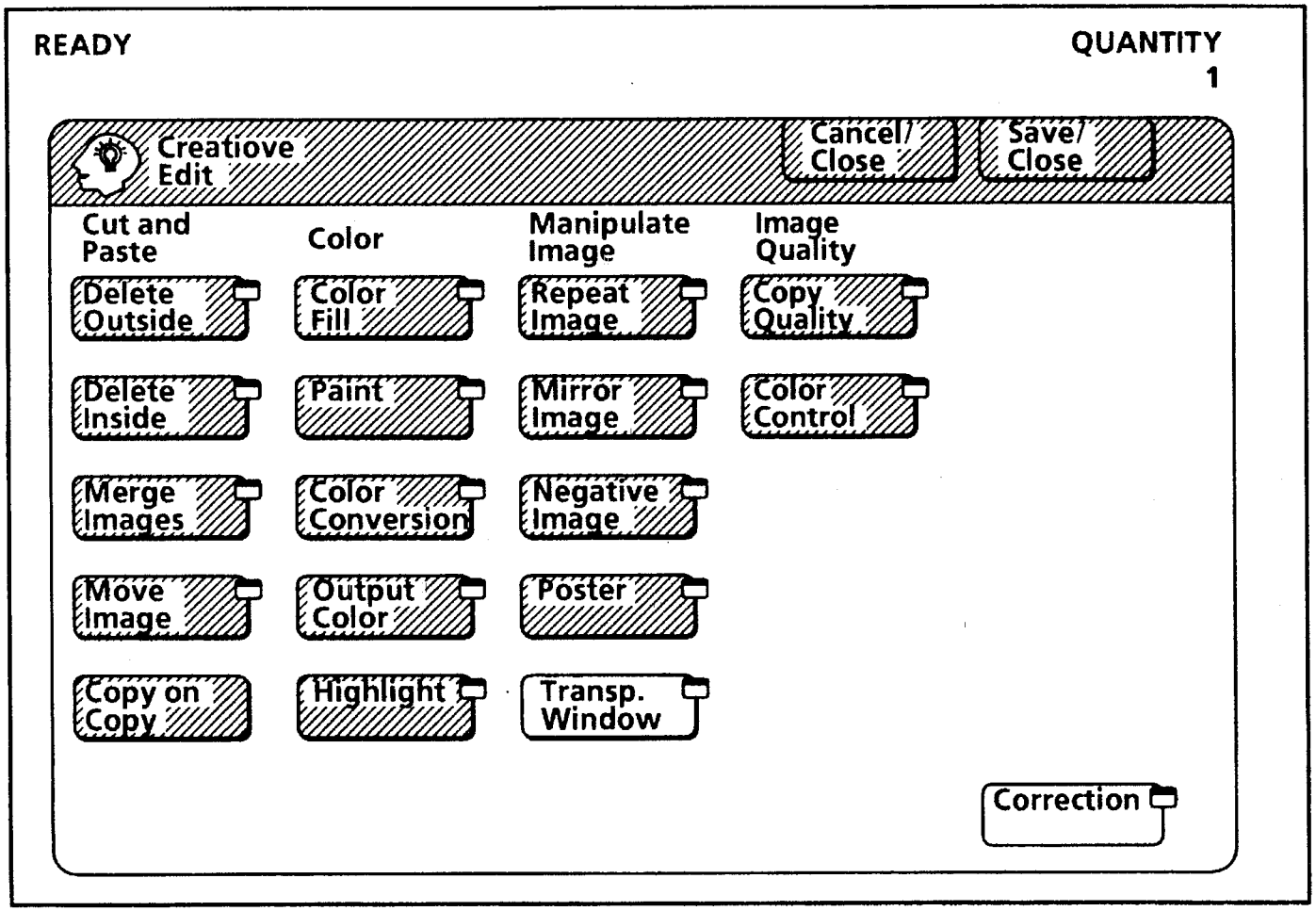
FIG. 5 is an elevation view of a touch screen and/or display which may incorporate the features of the present invention therein.

FIG. 5 shows a touch screen panel such as may be displayed upon selection of the creative edit function shown in FIG. 2 or FIG. 3. The transparency window function is shown in FIG. 4 divider sheets 1D, 2D, and 3D, and is used to create a reduced size image is accompanied by additional background information or blank areas of a sheet for note taking by presenter. Using the Edit pad 103 of FIG. 1, an operator may paint images, draw lines to connect associated explanations and graphics (document 1D of FIG. 4) add, subtract or alter various colors, highlight portions of images, and many other functions.

Figure 6:
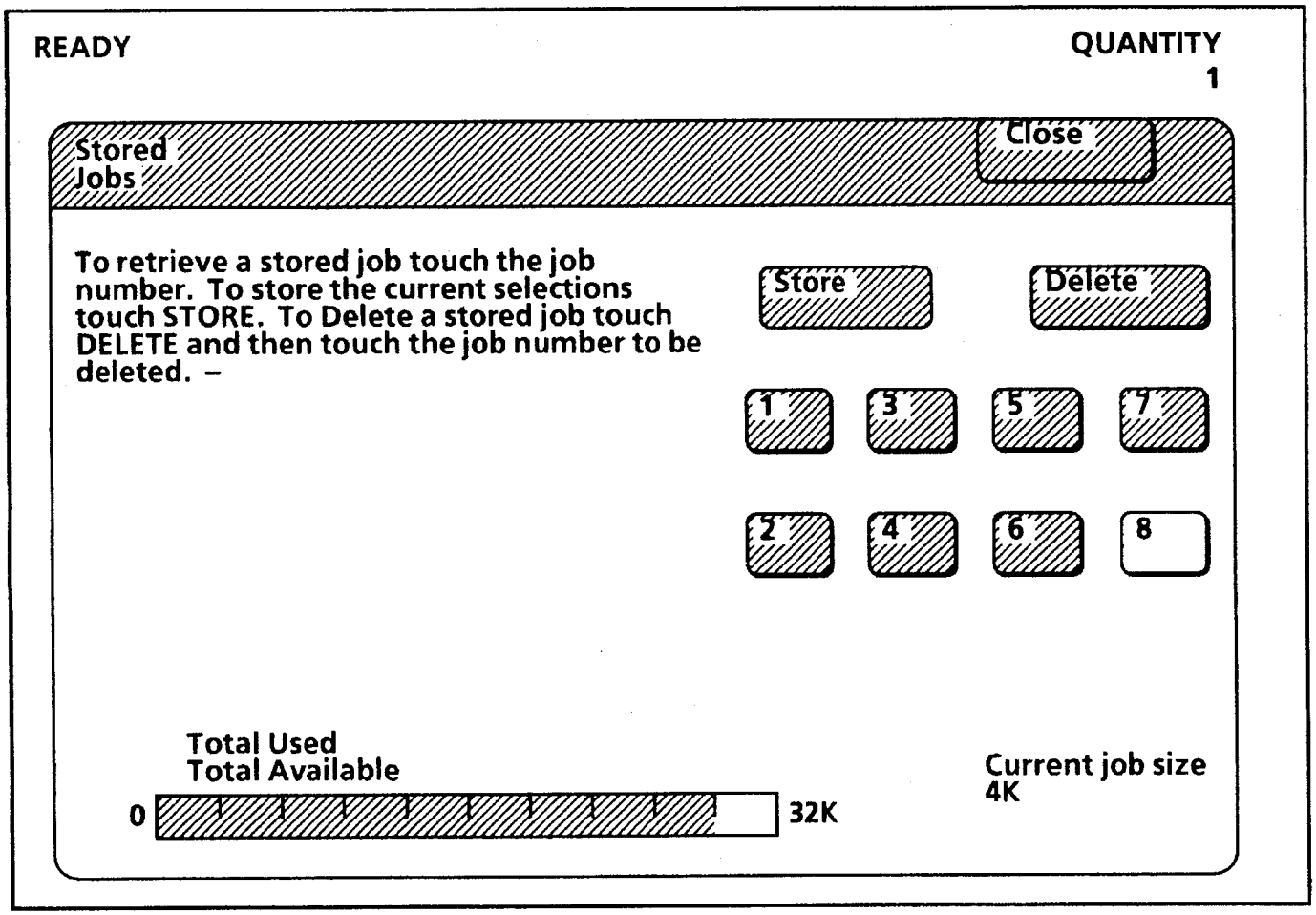
FIG. 6 is an elevation view of a memory touch screen and/or display which may incorporate the features of the present invention therein.

FIG. 6 shows a store job touch screen display, in which UI resident memory or a memory card (not shown) inserted into a slot such as memory card slot 102 as shown in FIG. 1 is used to store presentation/supporting set jobs. Each of the eight numbered store job numbered buttons 1–8 such that a transparency and presentation set such as shown in FIG. 4 can be stored for future use and recall as desired by an operator. The stored jobs function can be used to store job format, order, or the entire job to include sheet markings, etc. For example, stored job locations 1–4 might be used to store a job order for printing the job of FIG. 4 into three stacks in sorter 105 as shown in FIG. 1. A resulting stack/sheet set order might be the sequence:

Stack 1 (interleaved, unstapled, 1 set each): 1D, 1T, 2D, 2T, 3D, 3T Stack 2 (one serially ordered, stapled set): 1M, 1MA, 1MB, 2M, 2MA, 3M, 3MA, 3MB, 3MC Stack 3 (ten serially ordered, stapled sets, each including): 1H, 1HA, 1HB, 2H, 2HA, 3H, 3HA, 3HB, 3HC Less (or more) complex stack/sheet set order formats might also be used in accordance with the present invention, such as the following sequence, in which the user need only select or change a quantity number to be the number and type of handouts sets created: 1T, 1D, 2T, 2D, 3T, 3D; (5 sets, stapled) 1H, 2H, 3H.

Various embodiments of a presentation and supporting document sets producing system have been described. While the present invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

We claim:

1. An apparatus for producing sorted document sets, comprising:

generating means for producing a set of presentation documents including a primary image area thereon;

input means for producing a set of supporting documents including an edited image area thereon; and output means for sorting and displaying the set of presentation documents from said generating means and the set of supporting documents from said input means.

2. The apparatus of claim 1, wherein said output means comprises:

a printing system for printing the primary image area of the set of presentation documents on a plurality of presentation sheets and for printing the edit image area of the set of supporting documents on a plurality of supporting sheets; and a sheet sorter for sorting the presentation sheets relative to the supporting sheets.

3. The apparatus of claim 2, wherein:

the presentation sheets comprise transparent sheets; and the supporting sheets comprise paper sheets.

4. The apparatus of claim 2, wherein the presentation sheets comprise opaque sheets.

5. The apparatus of claim 1, wherein said generating means comprises a digital scanner for producing the set of presentation documents.

6. The apparatus of claim 1, wherein the set of presentation documents and the set of supporting documents are computerized display images and wherein said output means comprises a display screen.

7. The apparatus of claim 1, wherein the set of presentation documents comprises n presentation sheets and wherein the set of supporting documents comprises n supporting sheets, and wherein said output means alternating interleaves each supporting sheet after each presentation sheet.

8. The apparatus of claim 1, wherein the set of presentation documents comprises n presentation sheets and wherein the set of supporting documents comprises n supporting sheets, and wherein said output means alternating interleaves each presentation sheet after each supporting sheet.

9. The apparatus of claim 1, wherein said input means for producing the edited image area comprises a user interface including a touch screen.

10. The apparatus of claim 1, wherein said input means for producing the edited image area comprises a user interface including an input pad.

11. The apparatus of claim 10, wherein the edited image area of the supporting document set includes a modified version of the primary image area of the presentation document set.

12. The apparatus of claim 11, wherein said input means alters at least one color of the modified version of the primary image area included in the edited image area of the supporting document set.

13. The apparatus of clam 11, wherein said input means alters a size of the modified primary image area included in the edited image area of the supporting document set.

14. The apparatus of claim 1, further comprising a memory for recalling an output sort order of the set of presentation documents and the set of supporting documents.

15. The apparatus of claim 1, further comprising a memory for storing the set of presentation documents and the set of supporting documents.

* * * * *